US010500849B1

(12) United States Patent
Ernst et al.

(10) Patent No.: US 10,500,849 B1
(45) Date of Patent: Dec. 10, 2019

(54) PRINTHEAD WAVEFORM ADJUSTMENT

(71) Applicants: Larry M Ernst, Longmont, CO (US); Nikita Gurudath, Boulder, CO (US); Shinta Moriya, Boulder, CO (US); Mikel John Stanich, Longmont, CO (US)

(72) Inventors: Larry M Ernst, Longmont, CO (US); Nikita Gurudath, Boulder, CO (US); Shinta Moriya, Boulder, CO (US); Mikel John Stanich, Longmont, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/119,482

(22) Filed: Aug. 31, 2018

(51) Int. Cl.
*B41J 29/393* (2006.01)
*B41J 2/045* (2006.01)

(52) U.S. Cl.
CPC ..... *B41J 2/04588* (2013.01); *B41J 2/04586* (2013.01)

(58) Field of Classification Search
CPC combination set(s) only.
See application file for complete search history.

(56) References Cited

U.S. PATENT DOCUMENTS 5,502,468 A * 3/1996 Knierim ..... B41J 2/04506 347/19
6,554,388 B1 * 4/2003 Wong ..... B41J 29/393 347/14
7,008,036 B2 * 3/2006 Ju ..... B41J 2/04528 347/14
7,722,145 B2 5/2010 Kubota
7,766,447 B2 * 8/2010 Snyder ..... B41J 2/2128 347/14
8,300,266 B2 10/2012 Yeh et al.
8,322,811 B2 12/2012 Chandu et al.
8,662,616 B2 3/2014 Steurrys et al.
8,801,136 B2 * 8/2014 Chen ..... H04N 1/407 347/15
8,801,140 B2 8/2014 Viturro et al.
8,851,601 B2 10/2014 Zhang et al.
9,205,691 B1 12/2015 Jones et al.
9,718,269 B2 8/2017 Duffield et al.

* cited by examiner

*Primary Examiner* — Lam S Nguyen
(74) *Attorney, Agent, or Firm* — Duft & Bornsen, PC

(57) ABSTRACT

Systems and methods are provided for printhead waveform adjustment. One embodiment is a system that includes a controller that correlates a series of printhead waveforms input to a printhead with a series of optical density values output by the printhead. The controller determines a single target optical density for the printheads based on an average optical density of the printheads. Also, for each of the printheads, the controller determines a functional relationship between the parameter of the printhead waveforms input to the printhead and the optical density values output by the printhead, and determines a target printhead waveform parameter for the printhead based on the single target optical density input to an inverse of the functional relationship. The controller updates printhead settings to include information of the target printhead waveform parameter determined for each of the printheads for applying to the printheads to output ink at consistent optical density.

20 Claims, 8 Drawing Sheets

PRINTHEAD WAVEFORM ADJUSTMENT

FIELD OF THE INVENTION

The invention relates to the field of printing, and in particular, to printhead waveform adjustment.

BACKGROUND

Entities with substantial printing demands often use a production printer such as a continuous-forms printer that prints on a web of print media at high-speed (e.g., a hundred pages per minute or more). A production printer typically includes a print controller that controls the overall operation of the printing system, and a print engine. The print engine has multiple printheads and each printhead includes many nozzles that discharge ink as controlled by the printhead controller. During printing, the recording medium passes underneath the nozzles of the printheads as ink is ejected at appropriate times to form a printed image in accordance with image data.

To produce high quality images, it is generally desirable for the amount ink ejected by nozzles and printheads to be consistent in relation to other nozzles and other printheads. Existing print uniformity techniques tend to focus on calibrating nozzles via image analysis to uniformly eject with respect to other nozzles. However, nozzle uniformity operations may be less effective if ejection inconsistencies exist at the printhead level. Additionally, existing techniques for adjusting printheads to output drops consistently with respect to one another are cumbersome procedures that involve many iterations of manual adjustments. Accordingly, improved techniques for printhead ejection uniformity is desired.

SUMMARY

Embodiments described herein provide printhead waveform adjustment. The techniques described herein generate a baseline set of waveform signals to apply to corresponding printheads to cause all of the printheads within a group to print with consistent drop size volumes to generate the same (or substantially the same) optical density. Consistent optical density means that the level of ink deposition for each printhead within a group of printheads is substantially the same (e.g., printheads print with less than 1.5 average Delta E), where ink deposition is total ink volume or ink mass per unit area. An optimized value of a waveform parameter (e.g., voltage, frequency, pulse width, etc.) is determined efficiently and accurately for each printhead by characterizing a range of waveform inputs in relation to optical density outputs measured from a specially designed test pattern. The objective for the selection of the optimized waveforms for each printhead is to produce the same average drop sizes or ink deposition for the entire set of printheads. Advantageously, optimal values may be determined in a single pass to reduce make ready time at installation or performing maintenance operations on the printer. Additional benefits are described in detail in the description that follows.

One embodiment is a system that includes a printhead optical density controller configured, for each of a plurality of printheads, to correlate a series of printhead waveforms input to a printhead with a series of optical density values output by the printhead in response to the printhead waveforms, wherein a parameter of the printhead waveforms input to the printhead varies over a range of values for the series of the printhead waveforms. The printhead optical density controller is further configured, for each of the printheads, to determine a single target optical density for the printheads based on an average optical density of the printheads, to determine a functional relationship between the parameter of the printhead waveforms input to the printhead and the optical density values output by the printhead, and to determine a target printhead waveform parameter for the printhead based on the single target optical density input to an inverse of the functional relationship. The printhead optical density controller is further configured to update printhead settings to include information of the target printhead waveform parameter determined for each of the printheads for applying to the printheads to output ink at consistent optical density.

In a further embodiment, the print controller is configured to instruct the printheads to print the print patches as a grid of tones with rows across a width of a print medium and columns along a length of the print medium, wherein each row of the print patches is printed with a constant numerical value of the parameter applied to the printheads, and wherein a number of columns of the print patches corresponds with one printhead and the columns printed with a range of numerical values of the parameter such that the parameter applied to the printheads varies across the rows to differentiate the rows. In a further embodiment, the printhead optical density controller is further configured to determine the single target optical density of each of the printheads by: determining a spectrum of values of the parameter for each of the printheads for which satellite-free patches are printed, averaging optical density measurements of satellite-free patches printed by the printheads, and averaging optical density measurements of satellite-free patches printed by the printhead.

In yet a further embodiment, the printhead optical density controller is further configured, for each of the printheads, to determine the functional relationship by fitting a monotonic regression curve to data points plotting the parameter of the printhead waveforms input to the printhead versus the optical density values output by the printhead. In a further embodiment, printhead optical density controller is further configured, for each of the printheads, to determine the target printhead waveform parameter for the printhead by analyzing the monotonic regression curve to determine a single value of the parameter to apply to the printhead to match the single target optical density. In still a further embodiment, the printhead optical density controller is further configured to determine the target printhead waveform parameter for each of the printheads with a single-pass optimization. In a further embodiment, the printhead optical density controller further configured to correlate the optical density values with one or more of a color, an ink type, and a printhead assembly. In a further embodiment, the system includes at least one physical memory device to store printhead optical density adjustment logic. One or more processors coupled with the at least one physical memory device, are configured to execute the printhead optical density adjustment logic to perform functions of the printhead optical density controller.

Another embodiment is a method that includes correlating, for each of a plurality of printheads, a series of printhead waveforms input to a printhead with a series of optical density values output by the printhead in response to the printhead waveforms, wherein a parameter of the printhead waveforms input to the printhead varies over a range of values for the series of the printhead waveforms. The method further includes determining a single target optical density for the printheads based on an average optical density of the printheads. The method further includes determining, for each of the printheads, a functional relationship between the parameter of the printhead waveforms input to the printhead and the optical density values output by the printhead, and determining, for each of the printheads, a target printhead waveform parameter for the printhead based on the single target optical density input to an inverse of the functional relationship. The method also includes updating printhead settings to include information of the target printhead waveform parameter determined for each of the printheads for applying to the printheads to output ink at the consistent optical density.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific example embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
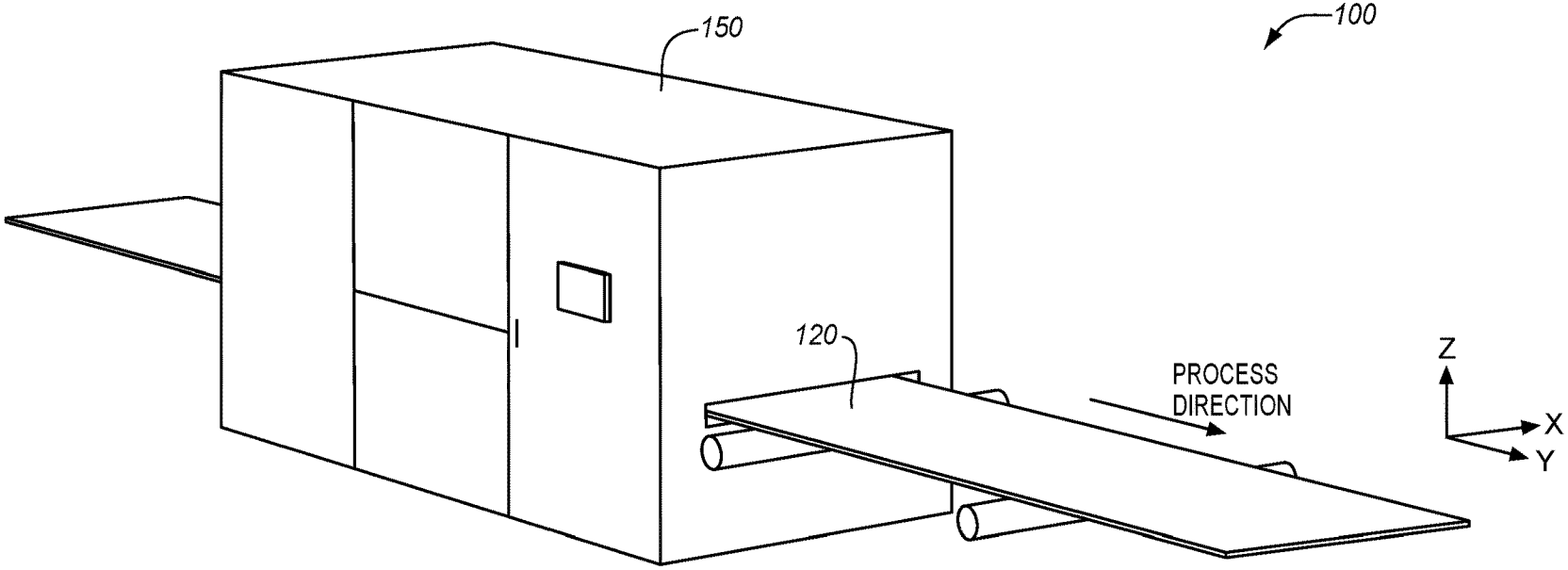
FIG. 1 illustrates a printing system in an illustrative embodiment.

FIG. 1 illustrates a printing system 100 in an illustrative embodiment. The printing system 100 includes a printer 150 to apply marks to a print medium (e.g., paper). The printing system 100 includes a printer 150 that applies marks to a print medium 120. The applied marking material may comprise ink in the form of any suitable fluid (e.g., aqueous inks, oil-based paints, additive manufacturing materials, etc.) for marking the print medium 120. As shown in this example, the printer 150 may comprise a continuous-form inkjet printer that prints on a web of continuous-form media, such as paper or plastic. However, embodiments described herein may apply to alternative print systems such as cut-sheet printers, wide format printers, etc. and their corresponding print media. FIG. 1 illustrates a direction in which the print medium 120 travels during printing (i.e., a process direction or Y direction), a lateral direction perpendicular to a Y direction (i.e., a cross-process direction or X direction), and a Z direction.

Figure 2:
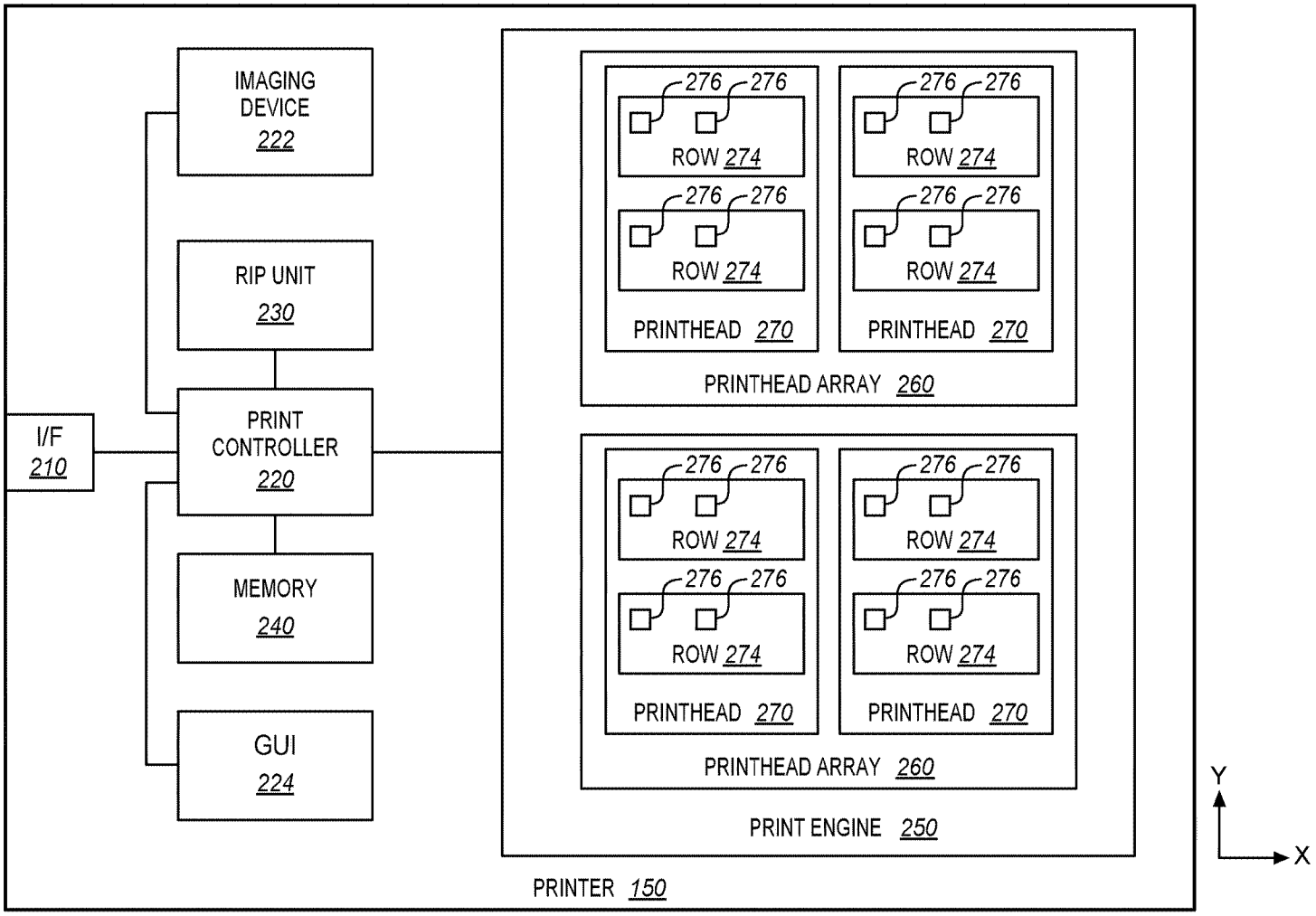
FIG. 2 is a block diagram of a printer in an illustrative embodiment.

FIG. 2 is a block diagram of the printer 150 in an illustrative embodiment. An interface 210 (e.g., Ethernet interface, Universal Serial Bus (USB) interface, etc.) receives print data (e.g., Page Description Language (PDL) print data) for printing, and a print controller 220 stores incoming print data in memory 240. This data may be rasterized by a Rasterization Image Processor (RIP) unit 230 into bitmap data and stored in memory 240 (or a separate print spool). Based on stored bitmap data, the print controller 220 provides marking instructions to a print engine 250. To facilitate analysis of print quality, an imaging device 222 (e.g., a camera, scanner, densitometer, spectrophotometer, etc.) captures images of printed content on the print medium 120. The imaging device 222 may be internal or external to the print engine 250. A graphical user interface (GUI) 224 displays printer information and receives user input for manipulating settings of the printer 150.

The print engine 250 may include multiple printhead arrays 260, and each array 260 may include multiple printheads 270. Additionally, each printhead 270 includes multiple rows 274 of nozzles 276 separated along the Y direction. Each nozzle 276 ejects drops of ink onto the print medium 120 (not shown in FIG. 2). The printheads 270 may be fixed during the operation of the printer 150 and thus each nozzle 276 at a printhead 270 may consistently mark a specific, predefined location along the X direction. In another embodiment, the printheads 270 may not be fixed and may be directed to move in the X direction via movement mechanisms. During printing, bitmap image data, such as halftone drop size image data, defines which of the nozzles 276 eject ink, thereby converting digital information into printed images on the print medium 120.

Each array 260 may comprise printheads 270 that form one or more color planes for the printer 150. For example, one array 260 may include exclusively nozzles that discharge Cyan (C) ink, one array 260 may include exclusively nozzles that discharge Yellow (Y) ink, one array 260 may include exclusively nozzles that discharge Magenta (M) ink, and one array 260 may include exclusively nozzles that discharge Black (K) ink. Alternatively, each printhead array 260 or each printhead 270 may, in some embodiments, output a combination of CMYK colors. In further embodiments, the printer 150 may include at least two print engines 250 configured to print on different sides of the print medium 120 for duplex printing. Each nozzle 276 may be capable of ejecting drops of different sizes (e.g., small, medium, and large).

To output high quality images, it is generally desirable for a group of printheads 270 (e.g., printheads of an array 260 and/or printheads of a print engine 250) to produce an output which has uniform optical density in relation to other printheads 270 of the group. Although previous systems may use the imaging device 222 to analyze ink ejection uniformity among nozzles, adjustments to the nozzles may be less effective if ejection inconsistencies exist at the printhead level. Moreover, previous techniques for adjusting printheads 270 to output drops consistently with respect to one another are cumbersome procedures that involve many iterations of manual adjustments.

Figure 3:
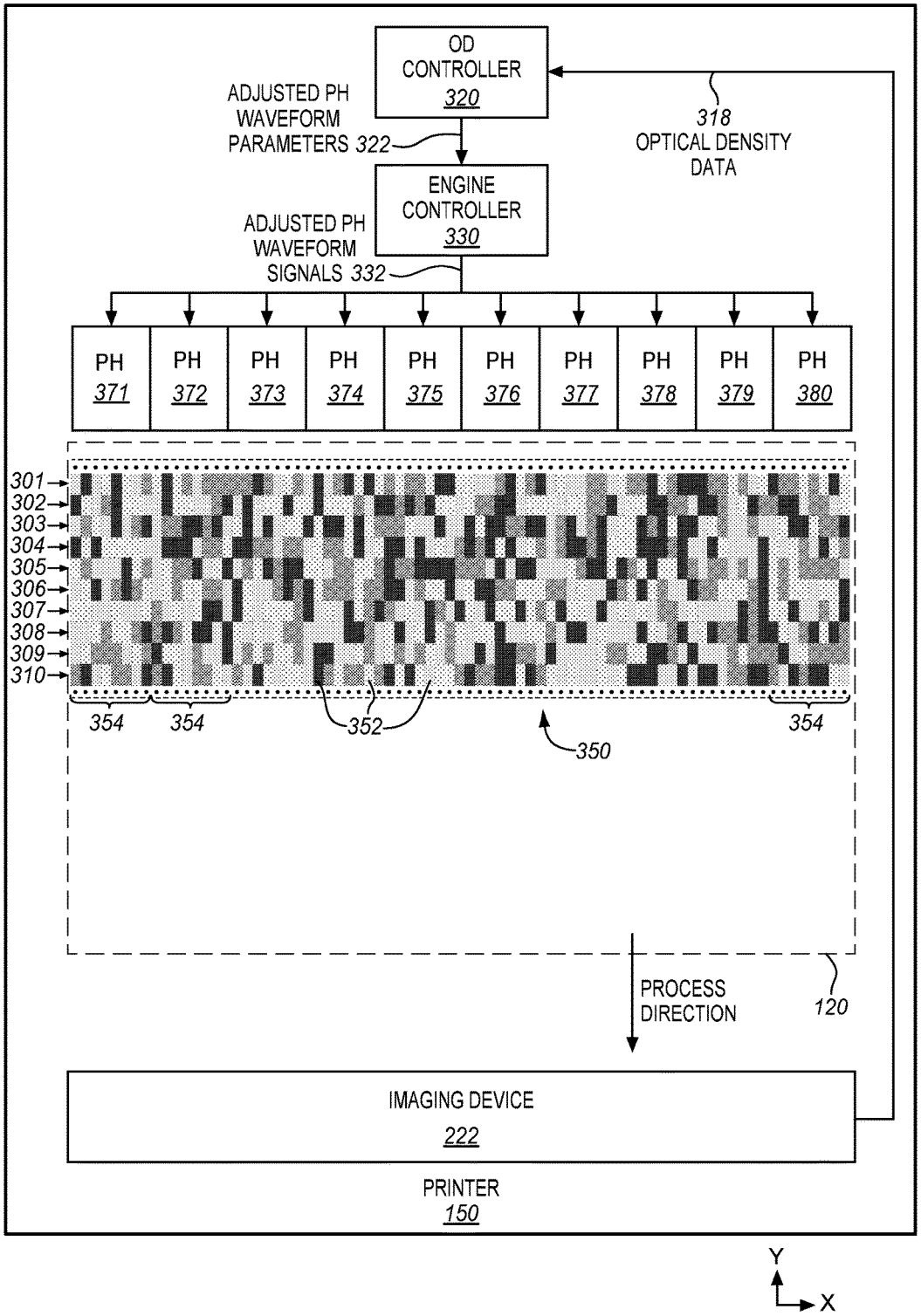
FIG. 3 is a diagram of a printer enhanced with printhead waveform adjustment in an illustrative embodiment.

FIG. 3 is a diagram of the printer 150 enhanced with printhead waveform adjustment in an illustrative embodiment. More particularly, the printer 150 is enhanced with an optical density (OD) controller 320 configured to determine adjusted printhead waveform parameters 322 from optical density data 318 obtained via the imaging device 222. Examples of the adjusted printhead waveform parameters 322 include a waveform voltage amplitude, a waveform frequency, a waveform pulse width, positive/negative slopes of a waveform, etc. Using the adjusted printhead waveform parameters 322 determined by the OD controller 320, an engine controller 330 generates adjusted printhead waveform signals 332 to apply to the printheads 371-380 for achieving consistent output at the printhead level. The engine controller 330 may include printhead driver circuit(s) and/or other printhead elements configured to drive printhead(s) 371-380 with electrical waveform signals. The adjusted printhead waveform parameters 322 may be expressed as symbolic values (e.g., voltage percentage values) representing different quantized gradations of basic waveform parameters such as amplitude, etc.

To determine the adjusted printhead waveform parameters 322 accurately and quickly, the OD controller 320 analyzes the optical density data 318 derived from a waveform parameter test pattern 350. The waveform parameter test pattern 350 is a specially configured printed test pattern that enables the OD controller 320 to efficiently correlate a series of printhead waveforms input to a printhead with a series of optical density values output by the printhead. In particular, in printing the waveform parameter test pattern 350, the printheads 371-380 output a grid of print patches 352, wherein vertical bands 354 of the print patches 352 correspond with individual ones of the printheads 371-380, and horizontal rows 301-310 of the print patches 352 are produced by corresponding waveform parameters. Accordingly, the waveform parameter test pattern 350 enables the OD controller 320 to perform techniques described in greater detail below for determining precise parameter values to control the printheads 371-380 to output at a consistent optical density with respect to one another.

Suppose, for example, that at installation of the printer 150, one or more of the printheads 371-380 output different optical density characteristics relative to other printheads. Further suppose that the OD controller 320 is configured to determine a waveform parameter (e.g., a voltage value) to apply each individual printhead 371-380 to achieve printhead optical density consistency. Accordingly, the OD controller 320 may (e.g., in conjunction with the print controller 220) generate test image data for printing the waveform parameter test pattern 350. That is, with the OD controller 320 set to optimize printhead waveform voltage, the image data of the waveform parameter test pattern 350 is configured to drive the print engine 250 to dynamically apply a series of waveforms with different voltage levels to the printheads 371-380 while printing the waveform parameter test pattern 350.

For example, each of the printheads 371-380 may print a first row 301 of the print patches 352 with a first waveform parameter value, a second row 302 of the print patches 352 with a second waveform parameter value, and so on such that a tenth row 310 of the print patches 352 prints with a tenth waveform parameter value applied to the printheads 371-380. In other words, in this example, the rows 301-310 correspond with a range of waveform parameters each having a unique voltage in the range of voltages, and the voltage value used to print each row may be constant for each of the print patches 352 in that row. Additionally, each of the printheads 371-380 may output bands 354 including a number of columns of the print patches 352 (e.g., eight print patches 352 per band 354 in the example shown in FIG. 3).

The print patches 352 may comprise specific tint levels of primary print colors to provide several measurement points across each of the printheads 371-380 for each primary color at different waveform parameter values. After the waveform parameter test pattern 350 is marked on the print medium 120, the imaging device 222 measures the optical density of the print patches 352 and provides the optical density data 318 to the OD controller 320. According to this example, measurements of the print patches 352 provide data for CMYK colors at ten different printhead waveform voltage levels. Additionally, an average of two measurements per primary color may be obtained for each of the printheads 371-380 since there are eight print patches 352 in each band 354 and four primary colors in that example. This provides adequate information to the OD controller 320 to define an optical density versus printhead voltage response for each of the printheads 371-380. Though a particular configuration of the waveform parameter test pattern 350 and the print patches 352 are shown in described for FIG. 3, it may be appreciated that alternative configurations are possible.

In general, the printheads 371-380 may comprise a group of printheads selected by the OD controller 320 to produce uniform optical density in relation to other printheads of the group. As such, the printheads 371-380 may be grouped according to a set of printheads that produce marks across the width of the print medium 120. Alternatively or additionally, the printheads 371-380 may be grouped according to the printhead assembly, array 260, or print engine 250 to which they belong. The printheads 371-380 of a group may be physically connected, abut each other, and/or arranged in interlaced or non-interlaced configurations.

The OD controller 320 may be configured to perform waveform adjustment functions for each of the multiple color planes of the printer 150, each ink type of the printer 150, each print resolution of the printing system 100, each array 260, and/or each print engine 250. The OD controller 320 may be electrically/communicatively coupled with the imaging device 222 and the engine controller 330. Additionally, the OD controller 320 may be electrically/communicatively coupled with various elements of the printer 150 described above with respect to FIG. 2, such as the print controller 220, GUI 224, and memory 240 (e.g., storing printhead waveform settings). For instance, the OD controller 320 may be coupled with each of the printheads 371-380 (e.g., via the print controller 220, printhead driving circuits, etc.) and also coupled with the imaging device 222. It will be appreciated that the particular number and arrangement of elements shown and described with respect to FIG. 2 and FIG. 3 are examples provided for purposes of discussion and that numerous additional, equivalent, and alternative elements and element arrangements are possible. Illustrative details of the operation of the OD controller 320 and related components are described below.

Figure 4:
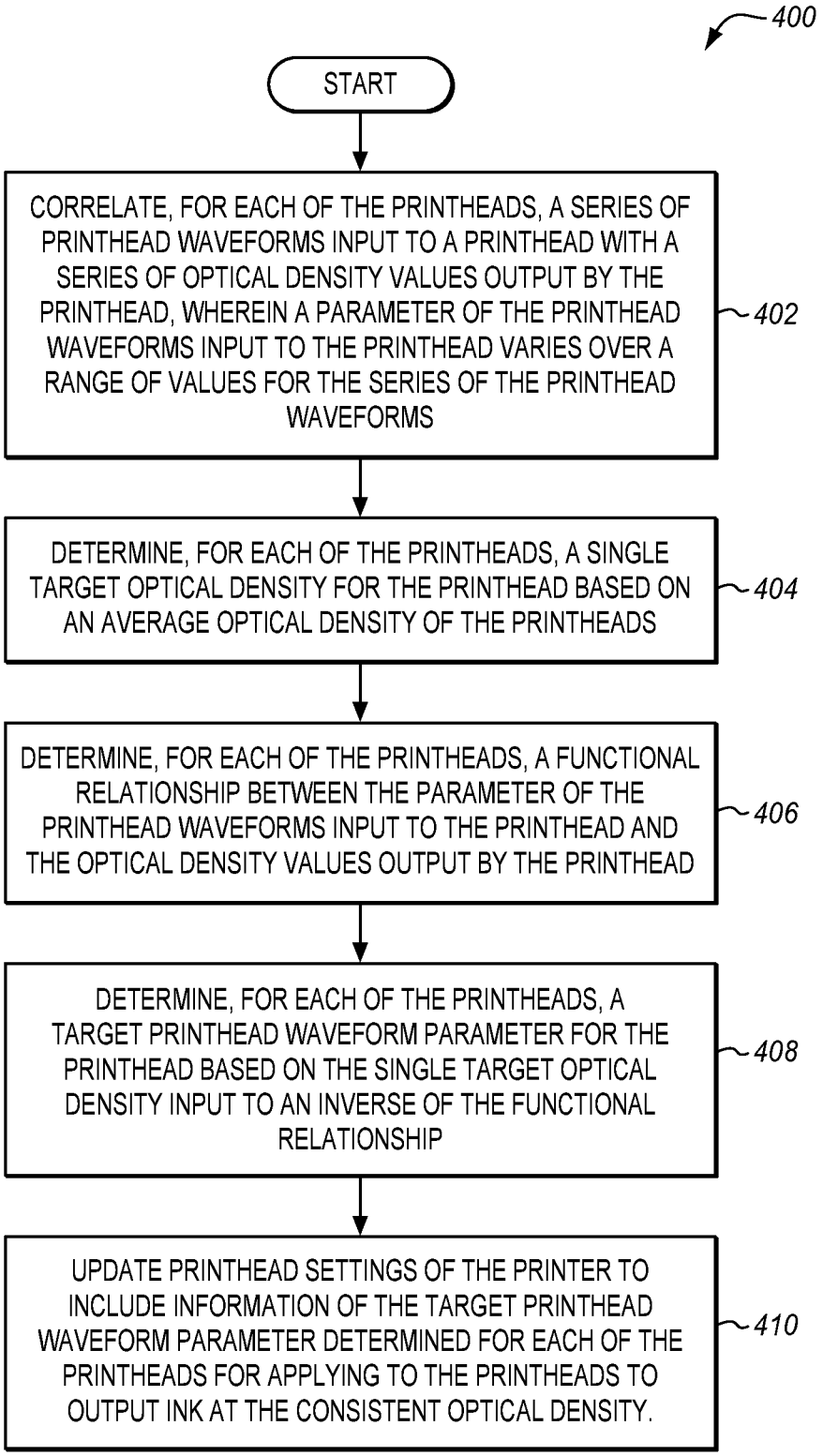
FIG. 4 is a flowchart illustrating a method for controlling printheads of a printer to output ink at consistent optical density in al illustrative embodiment.

FIG. 4 is a flowchart illustrating a method 400 for controlling printheads of a printer to output ink at consistent optical density in an illustrative embodiment. The steps of method 400 are described with reference to printing systems of FIGS. 1-3 but it will be appreciated that the method 400 be performed in other systems. The steps of the flowcharts described herein are not all inclusive and may include other steps not shown. The steps described herein may also be performed in an alternative order.

In some embodiments, the method 400 may be performed after a print shop operator or technician has finished installing a printer, a new set of printheads 371-380, and/or the power system that drives the printhead(s) 371-380. Alternatively or additionally, the method 400 may be performed according to maintenance operations automatically performed at periodic intervals or initiated by a user. For instance, the method 400 may initiate by input from a print shop operator (e.g., via the interface 210 and/or GUI 224) requesting the OD controller 320 to perform printhead waveform parameter adjustment. Though method 400 is described with respect to printheads 371-380, the OD controller 320 may select any suitable combination of printheads (e.g., based on user input from the print shop operator, criteria stored in memory 240, etc.). With the group of printheads 371-380 selected, the OD controller 320 (and/or the print controller 220) may proceed to generate print data defining a test pattern (e.g., the waveform parameter test pattern 350) to direct the engine controller 330 as desired. Additionally, the imaging device 222 may provide image data about the printed test pattern.

In step 402, the OD controller 320 correlates, for each of the printheads 371-380, a series of printhead waveforms input to a printhead with a series of optical density values output by the printhead, wherein a parameter of the printhead waveforms input to the printhead varies over a range of values (e.g., for each of rows 301-310) for the series of the printhead waveforms. As earlier described with respect to FIG. 3, the parameter variation may be defined by the configuration of the test pattern image data that directs the printheads 371-380 in printing the test pattern on the print medium 120. Additionally, determination of the optical density values output by each printhead 371-380 may be based on image analysis applied to a captured color patches printed in the test pattern.

The OD controller 320 may correlate the input/output by mapping characteristics of the test image data with characteristics of the test pattern output by the test image data. For instance, the OD controller 320 may determine that the test image data is configured to instruct the printheads 371-380 to print ten rows of print patches, wherein each row of the print patches is printed with a constant numerical value of the waveform parameter applied to the printheads 371-380. The OD controller 320 may also determine that a number of columns of the print patches that corresponds with one printhead. Accordingly, the OD controller 320 may track which of the printheads 371-380 have printed which of the print patches, the input waveform parameter used to output the print patches, and the optical density output on the print medium 120 resulting from a particular input value applied to a particular printhead.

In step 404, the OD controller 320 determines, for each of the printheads 371-380, a single target optical density for the printheads 371-380 based on an average optical density of the printheads 371-380. As such, the OD controller 320 may determine an average optical density for a group of printheads 371-380 (as opposed to a group of nozzles of a printhead) according to the test pattern output. In other words, the OD controller 320 may determine the average density output by the printheads 371-380 printing color tones over a range of printhead parameter values (e.g., printing the test pattern). The average may be calculated for measures of central tendencies of data such as arithmetic mean, mode, and weighted averages.

In step 406, the OD controller 320 determines, for each of the printheads 371-380, a functional relationship between the parameter of the printhead waveforms input to the printhead and the optical density values output by the printhead. In one embodiment, the OD controller 320 determines the functional relationship by fitting a strictly monotonic regression curve to data points plotting the parameter of the printhead waveforms input to the printhead versus the optical density values output by the printhead. For example, in determining optimal voltage values to apply to the printheads 371-380, a regression curve fit may be determined using the optical density data versus the printhead voltage data for each printhead for each primary color. The curve may be strictly monotonic (e.g., optical density increases with increasing parameter levels) so as to provide a single valued inverse function. A constrained polynomial such as a second order may be used to provide a smooth fit and single valued inverse function.

In step 408, the OD controller 320 determines, for each of the printheads 371-380, a target printhead waveform parameter for the printhead based on the single target optical density input to an inverse of the functional relationship. That is, using the target optical density determined in step 404 and the functional relationship determined in step 406, the OD controller 320 may determine the target printhead waveform parameter for the printhead by analyzing the monotonic regression curve to determine a single value of the parameter to apply to the printhead to match the target optical density of all printheads 371-380 in the group. Put another way, the OD controller 320 may determine a target waveform parameter for each printhead by using an inverse function for each printhead and an input target optical density that is the same for printheads 371-380 of the group.

In step 410, the OD controller 320 updates printhead settings of the printer to include information of the target printhead waveform parameter determined for each of the printheads for applying to the printheads to output ink at the consistent optical density. The OD controller 320 may update printhead settings of the printer by transmitting the target printhead waveform parameters to the corresponding print engine 250, engine controller 330, printheads 371-380, and/or printhead drivers, etc. Alternatively or additionally, the determined waveform parameter values for each printhead may be transmitted to memory (e.g., memory 240) to be used by the engine controller 330. Thus, the method 400 enables ink ejection consistency between printheads 371-380 to optimize print quality. The method 400 may be repeated for each print engine resolution, each primary color, each ink type, each print engine 250, and/or each array 260. In addition to providing an intermediate scale of uniformity compensation at the printhead level (as opposed to small scale uniformity at the nozzle level), the method 400 enables the printheads 371-380 to be precisely and individually tuned with a single pass optimization (e.g., no iterations).

Figure 5:
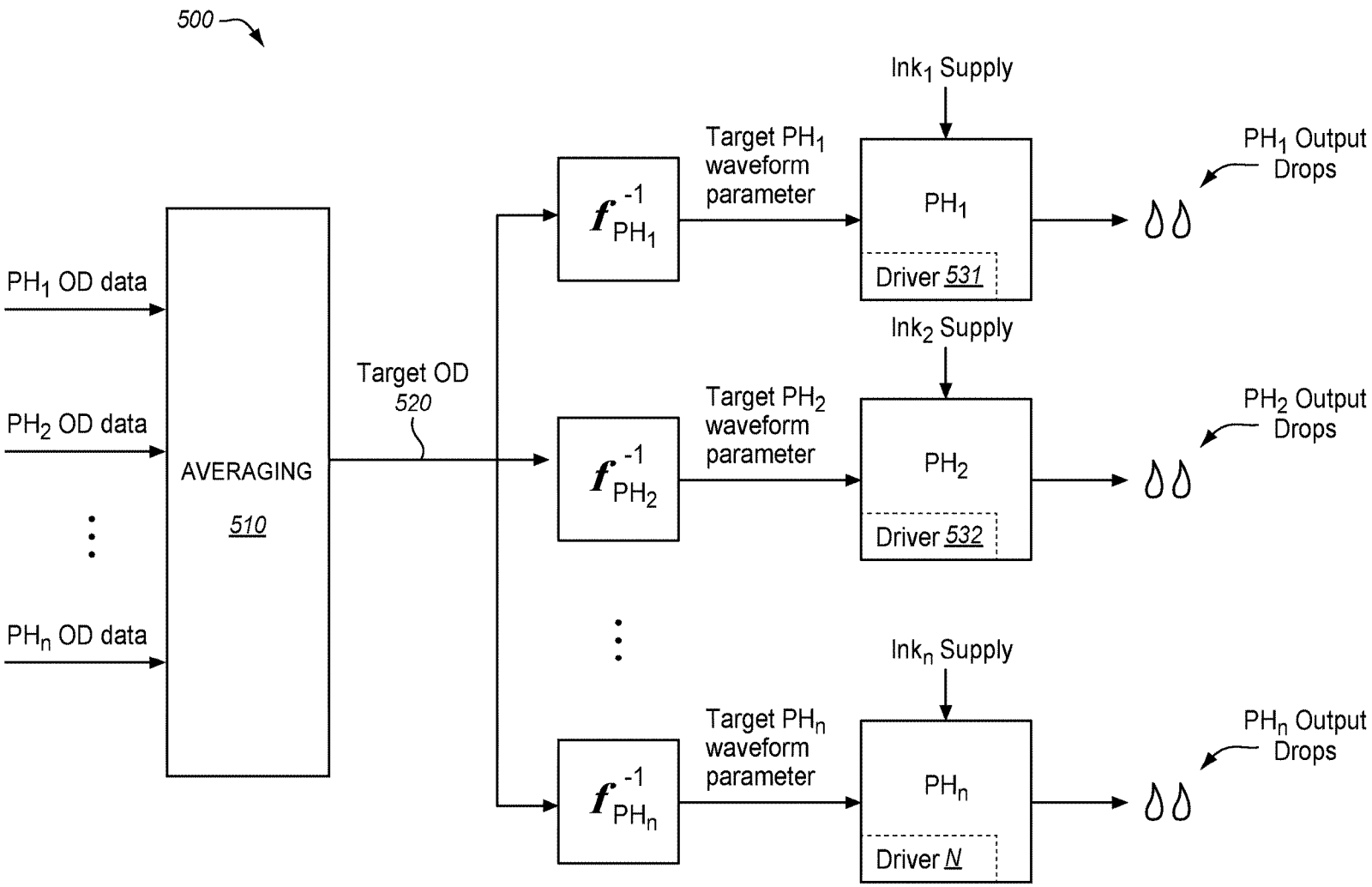
FIG. 5 is a flow diagram of determining a target waveform parameter for each printhead by using an inverse function for each printhead in an illustrative embodiment.

FIG. 5 is a flow diagram 500 of determining a target waveform parameter for each printhead by using an inverse function for each printhead in an illustrative embodiment. Optical density data for each printhead $PH_1$-$PH_N$ is input into an averaging function 510 to generate a target optical density 520. The target optical density 520 is common to printheads $PH_1$-$PH_N$ and is input to the inverse function for each printhead $PH_1$-$PH_N$. Thus, each printhead in an assembly may be set to the same target optical density. The functional relationship between density and a waveform parameter for each individual printhead $PH_1$-$PH_N$ may be based on a basis function (e.g., ordinary least squares (OLS) regression, Lasso regression, etc.). The target waveform parameter for each printhead $PH_1$-$PH_N$ may be transferred from a digital front end (DFE) to the engine controller 330 to generate a new set of printhead waveforms to subsequently use to drive each individual printhead at the new desired level during normal printing. The target waveform parameters (e.g., voltages) may be controlled by printhead drivers (e.g., drivers 531, 532, etc.) in the print engine 250 to generate an optical printhead response in terms of ink volume per drop size. In other words, a drive waveform generator per printhead may operate based on the waveform parameter determined for that printhead. Thus, across an array of printheads, the waveform parameter may vary. The OD controller 320 may program the drive waveform generator per printhead for subsequent normal printing operations. The print engine 250, engine controller 330, printheads 371-380 and/or printhead drivers 531, 532, etc. may also receive corresponding image data (not shown in FIG. 5), such as halftone drop size image data, to process together with the target waveform parameter to produce the output drops corresponding to the image data. The image data may be based on test data and/or print job data.

Additional criteria may be used to adjust the volume of ink dispersed by printheads relative to one another. In one embodiment, the OD controller 320 further determines optimal waveform parameter values based on satellite-free jetting for each printhead. That is, constraints such as satellite free jetting can be included by using optical density values which are only associated with satellite free performance. For example, the target printhead waveform parameter may be established by excluding consideration of waveform parameters having satellite jetting and including consideration of only the waveform parameters having satellite free jetting. This forms a subset of the possible optimal waveform parameters which ensures satellite free performance is achieved, in addition to equal optical density values for the printheads.

For example, the waveform parameter test pattern may include tones printed with density characteristics one or more times to characterize the density variation for each individual printhead as a function of allowable printhead waveform voltage settings. That is, the waveform parameter test pattern drives printheads to print with a voltage parameter that is adjusted in terms of relative peak to peak voltage in an individual printhead (i.e., not uniquely for an individual nozzle). Alternatively, the optimized waveform process may be performed with an assumption regarding the satellite free subset of waveforms and a final check performed which validates that the optimized waveforms achieve that objective. If satellite free performance is not achieved an adjustment may be made to the subset of waveforms used and the process repeated until the objective is met.

The OD controller 320 may determine the target optical density for all printheads for both engines of a system by averaging all OD measurements of rows 301-310, where satellite free jetting should occur. The OD controller 320 may set the waveform parameter for each printhead such that the average optical density equals a target optical density for a single voltage over a satellite-free voltage range. Additionally, the target optical density may be selected for either a particular tint or a combination of tint values. The tint(s) may be selected at a level (e.g., 60% tint) to obtain a high sensitivity to the waveform parameter adjustment for maximizing information of average density deviations. Since each specific tint level is associated with a variety of drop sizes, the selection of the tint level also determines which drop sizes are used. Multiple tint levels may be employed to determine the optimized waveform parameters for a range of different drop sizes.

Figure 6A:
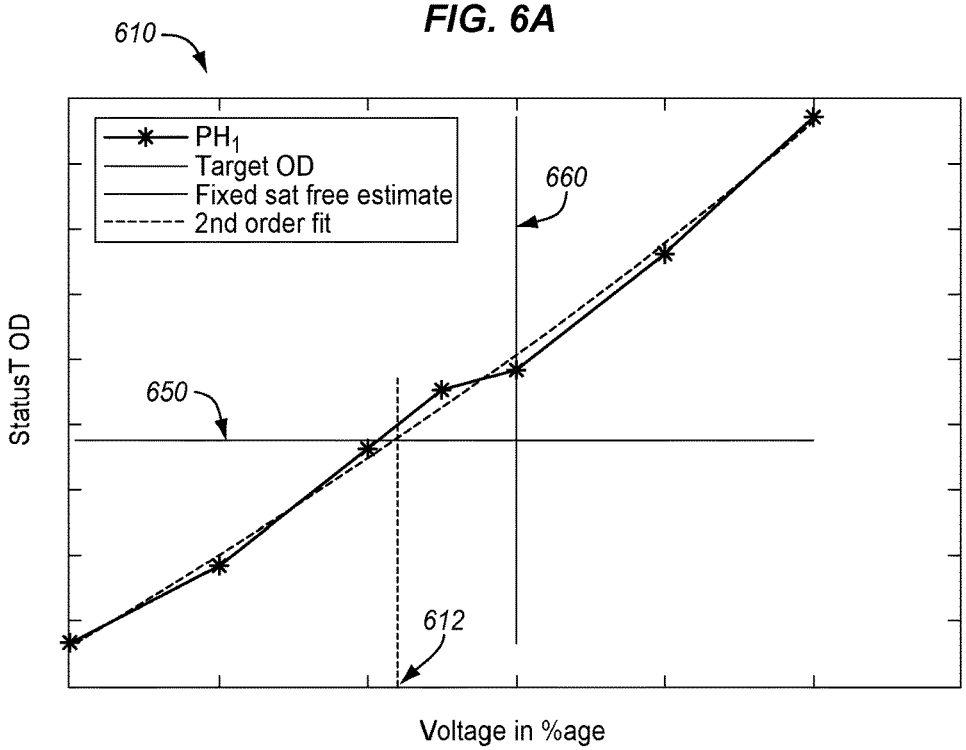
FIG. 6A is a data plot of voltage and optical density for determining an optimal voltage level for a first printhead in an illustrative embodiment.
Figure 6B:
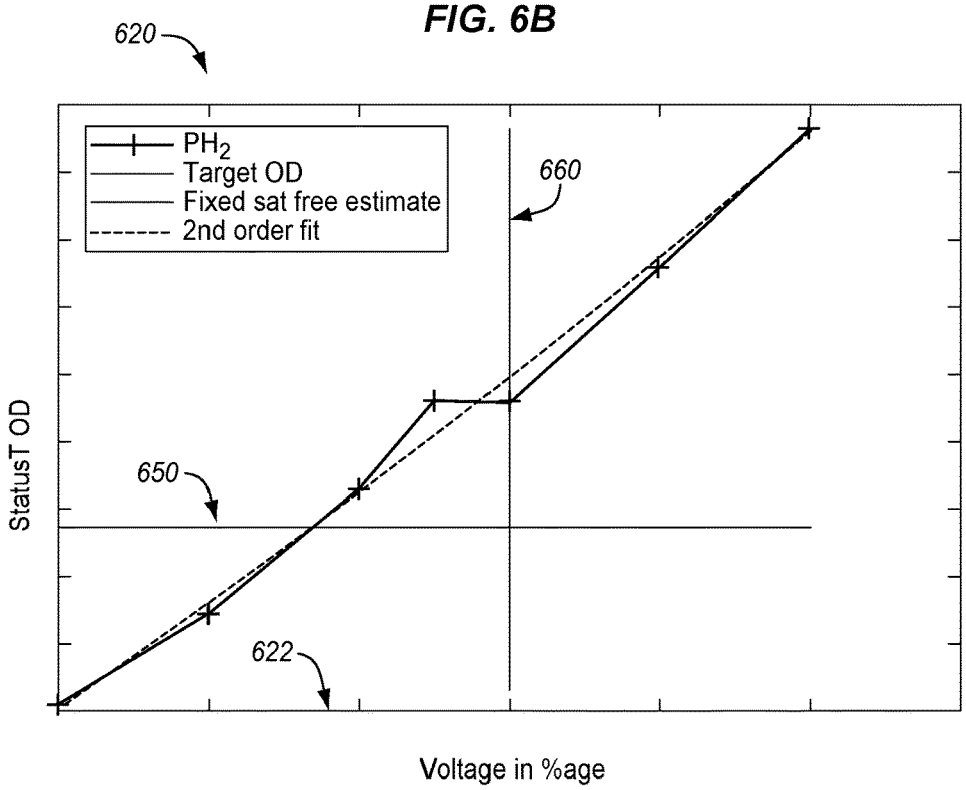
FIG. 6B is a data plot of voltage and optical density for determining an optimal voltage level for a second printhead in an illustrative embodiment.
Figure 6C:
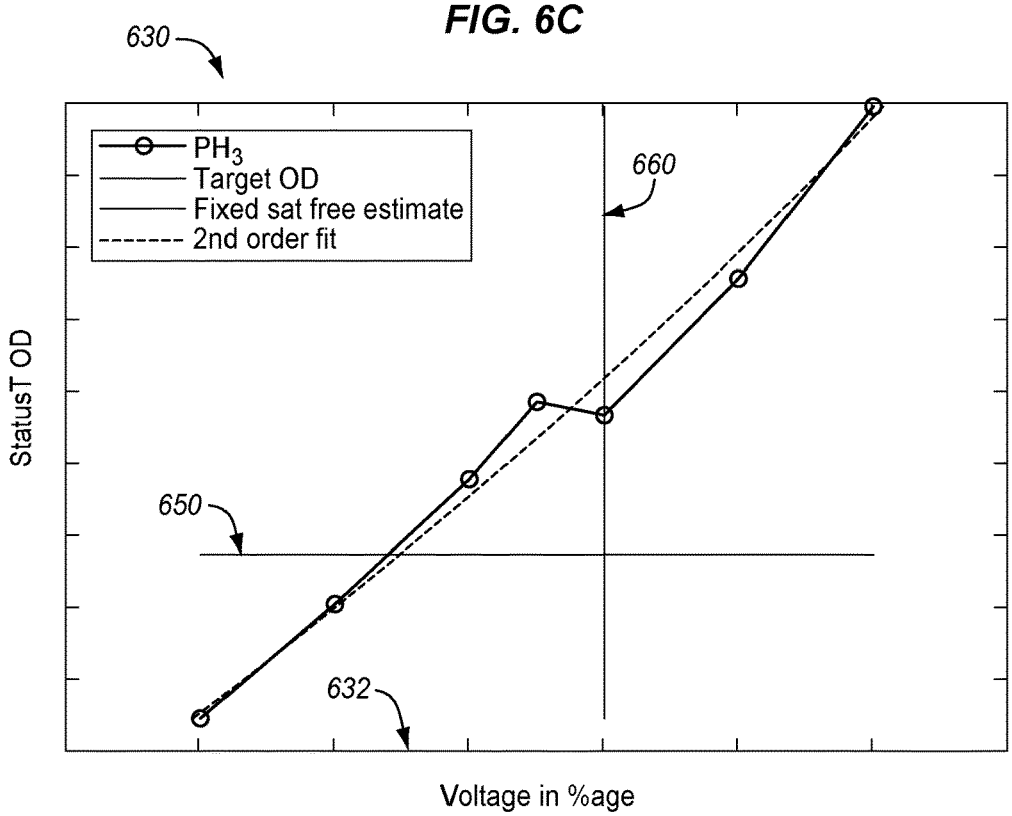
FIG. 6C is a data plot of voltage and optical density for determining an optimal voltage level for a third printhead in an illustrative embodiment.
Figure 6D:
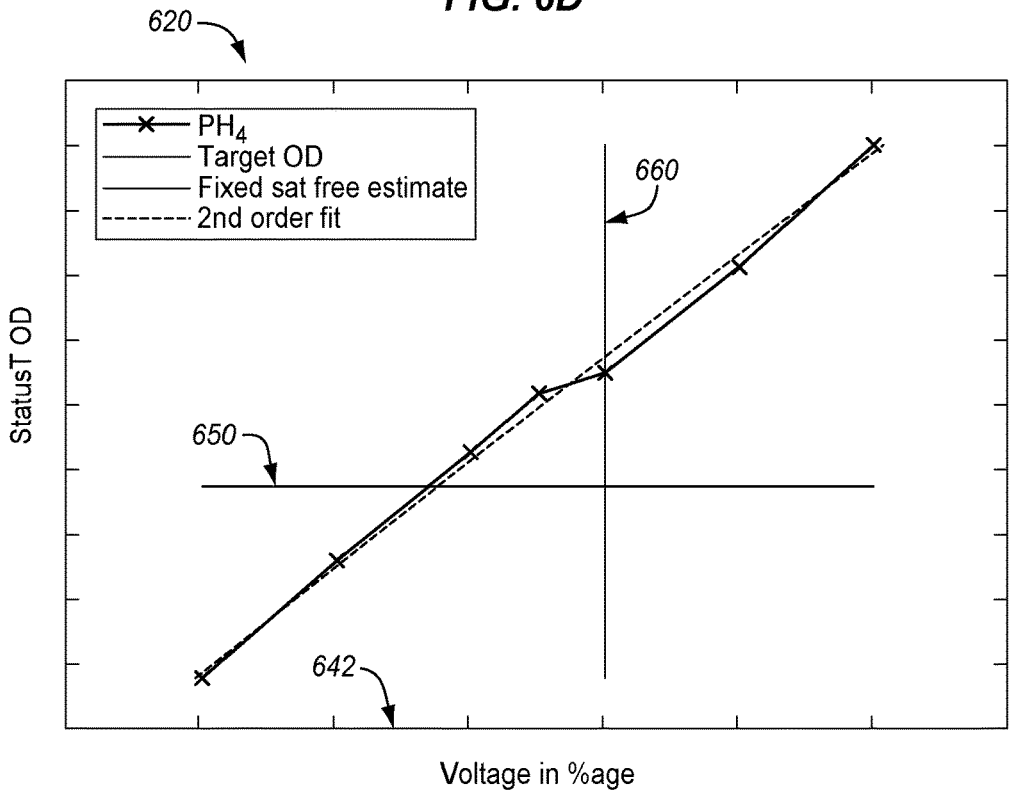
FIG. 6D is a data plot of voltage and optical density for determining an optimal voltage level for a fourth printhead in an illustrative embodiment.

FIG. 6A-6D illustrate data plots of voltages and optical density for determining a printhead voltage level to apply to each printhead for the Cyan color plane in an illustrative embodiment. FIG. 6A is a data plot 610 of voltage and optical density for determining an optimal voltage level for a first printhead in an illustrative embodiment. FIG. 6B is a data plot 620 of voltage and optical density for determining an optimal voltage level for a second printhead in an illustrative embodiment. FIG. 6C is a data plot 630 of voltage and optical density for determining an optimal voltage level for a third printhead in an illustrative embodiment. FIG. 6D is a data plot 640 of voltage and optical density for determining an optimal voltage level for a fourth printhead in an illustrative embodiment.

The OD controller 320 may determine the target optical density of each of the printheads by: determining a spectrum of values of the parameter for each of the printheads for which satellite-free patches are printed, averaging optical density measurements of satellite-free patches printed by the printheads, and averaging optical density measurements of satellite-free patches printed by the printhead. Image analysis applied to the captured test pattern may be used determine one or more characteristics of the drops of ink such as print patches that contain a threshold number of satellites. The OD controller 320 may therefore detect satellite-free patches from the captured image data provided by the imaging device 222.

As shown in FIGS. 6A-6D, the OD controller 320 may characterize, for a primary color (e.g., Cyan) of halftoned predefined tones across the full web width for all printheads. A single voltage parameter for each printhead (e.g., $PH_1$-$PH_4$) is determined to match the target average density over the printhead assembly with a single optimization. In this example, the satellite-free voltage range 660 is the same for each of $PH_1$-$PH_4$ and the target optical density 650 is the same for each of $PH_1$-$PH_4$. The OD controller 320 employs a second order regression curve to the plotted data to find a printhead voltage value where the average optical density equals a target optical density for the print head. That is, in this example, parameter 612 for $PH_1$ is determined, parameter 622 for $PH_2$ is determined, parameter 632 for $PH_3$ is determined, and parameter 642 for $PH_4$ is determined.

Figure 7:
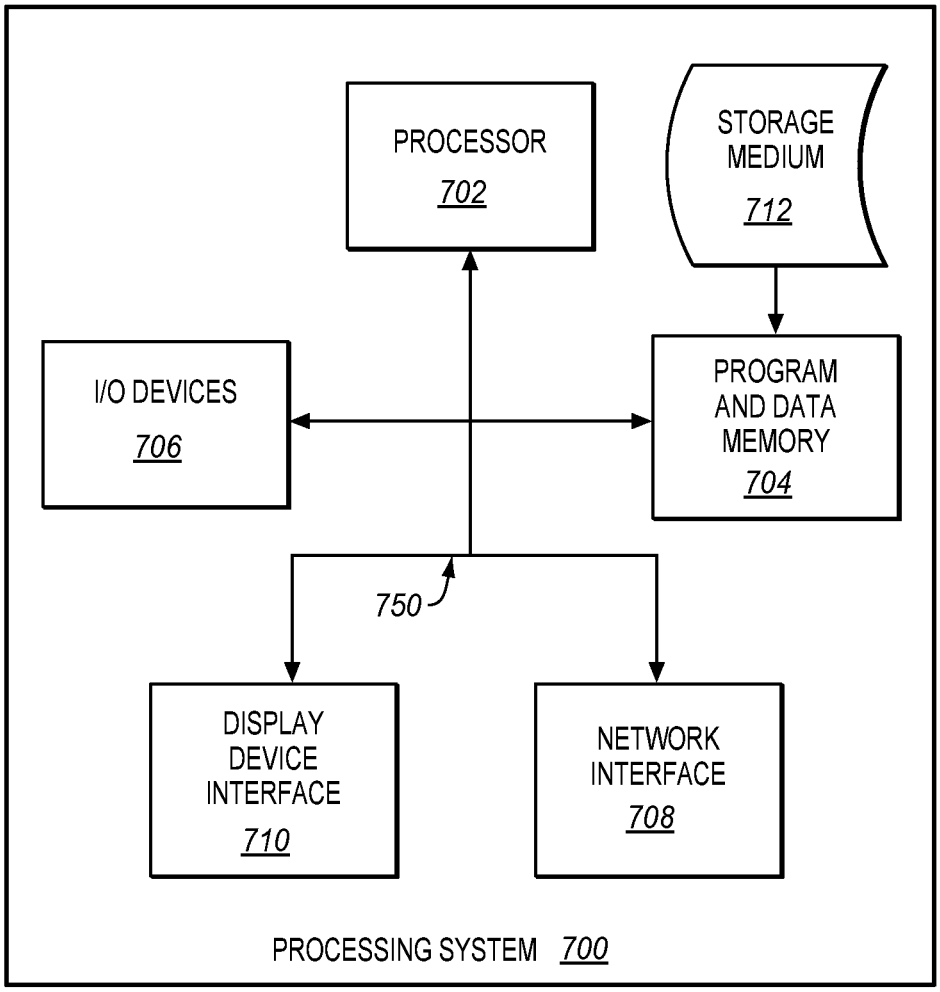
FIG. 7 illustrates a processing system operable to execute a computer readable medium embodying programmed instructions to perform desired functions in an illustrative embodiment.

Embodiments disclosed herein can take the form of software, hardware, firmware, or various combinations thereof. In one embodiment, functions described herein are implemented in software, which includes but is not limited to firmware, resident software, microcode, etc. used to direct a processing system of printing system 100 to perform the various operations disclosed herein. FIG. 7 illustrates a processing system 700 operable to execute a computer readable medium embodying programmed instructions to perform desired functions in an exemplary embodiment. Processing system 700 is operable to perform the above operations by executing programmed instructions tangibly embodied on computer readable storage medium 712. In this regard, embodiments of the invention can take the form of a computer program accessible via computer-readable medium 712 providing program code for use by a computer or any other instruction execution system. For the purposes of this description, computer readable storage medium 712 can be anything that can contain or store the program for use by the computer.

Computer readable storage medium 712 can be an electronic, magnetic, optical, electromagnetic, infrared, or semiconductor device. Examples of computer readable storage medium 712 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 700, being suitable for storing and/or executing the program code, includes at least one processor 702 coupled to program and data memory 704 through a system bus 750. Program and data memory 704 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 706 (including but not limited to keyboards, displays, pointing devices, etc.) can be coupled either directly or through intervening I/O controllers. Network adapter interfaces 708 may also be integrated with the system to enable processing system 700 to become coupled to other data processing systems or storage devices through intervening private or public networks. Modems, cable modems, IBM Channel attachments, SCSL Fibre Channel, and Ethernet cards are just a few of the currently available types of network or host interface adapters. Display device interface 710 may be integrated with the system to interface to one or more display devices, such as printing systems and screens for presentation of data generated by processor 702.

Although specific embodiments were described herein, the scope is not limited to those specific embodiments. Rather, the scope is defined by the following claims and any equivalents thereof.

What is claimed is:

1. A system comprising:

a printhead optical density controller configured, for each of a plurality of printheads, to correlate a series of printhead waveforms input to a printhead with a series of optical density values output by the printhead in response to the printhead waveforms, wherein a parameter of the printhead waveforms input to the printhead varies over a range of values for the series of the printhead waveforms;

the printhead optical density controller further configured, for each of the printheads, to determine a single target optical density for the printheads based on an average optical density of the printheads, to determine a functional relationship between the parameter of the printhead waveforms input to the printhead and the optical density values output by the printhead, and to determine a target printhead waveform parameter for the printhead based on the single target optical density input to an inverse of the functional relationship;

the printhead optical density controller further configured to update printhead settings to include information of the target printhead waveform parameter determined for each of the printheads for applying to the printheads to output ink at consistent optical density.

2. The system of claim 1, further comprising:

a printer that includes the printheads and a print controller, wherein the print controller is configured to instruct the printheads to output print patches used to correlate the series of the printhead waveforms with the series of the optical density values for each of the printheads, and wherein the printhead optical density controller is further configured to program the printheads according to the target printhead waveform parameter determined for each of the printheads.

3. The system of claim 2, wherein:

the print controller is configured to instruct the printheads to print the print patches as a grid of tones with rows across a width of a print medium and columns along a length of the print medium, each row of the print patches is printed with a constant numerical value of the parameter applied to the printheads, a number of columns of the print patches corresponds with one printhead and the columns printed with a range of numerical values of the parameter such that the parameter applied to the printheads varies across the rows to differentiate the rows.

4. The system of claim 3, wherein:

the printhead optical density controller is further configured to determine the single target optical density of each of the printheads by: determining a spectrum of values of the parameter for each of the printheads for which satellite-free patches are printed, averaging optical density measurements of satellite-free patches printed by the printheads, and averaging optical density measurements of satellite-free patches printed by the printhead.

5. The system of claim 4, wherein:

the printhead optical density controller is further configured, for each of the printheads, to determine the functional relationship by fitting a monotonic regression curve to data points plotting the parameter of the printhead waveforms input to the printhead versus the optical density values output by the printhead.

6. The system of claim 5, wherein:

the printhead optical density controller is further configured, for each of the printheads, to determine the target printhead waveform parameter for the printhead by analyzing the monotonic regression curve to determine a single value of the parameter to apply to the printhead to match the single target optical density, the printhead optical density controller is further configured to determine the target printhead waveform parameter for each of the printheads with a single-pass optimization.

7. The system of claim 1, wherein:

the printhead optical density controller further configured to correlate the optical density values with one or more of a color, an ink type, and a printhead assembly.

8. A method comprising:

correlating, for each of a plurality of printheads, a series of printhead waveforms input to a printhead with a series of optical density values output by the printhead in response to the printhead waveforms, wherein a parameter of the printhead waveforms input to the printhead varies over a range of values for the series of the printhead waveforms;

determining a single target optical density for the printheads based on an average optical density of the printheads;

determining, for each of the printheads, a functional relationship between the parameter of the printhead waveforms input to the printhead and the optical density values output by the printhead;

determining, for each of the printheads, a target printhead waveform parameter for the printhead based on the single target optical density input to an inverse of the functional relationship; and updating printhead settings to include information of the target printhead waveform parameter determined for each of the printheads for applying to the printheads to output ink at consistent optical density.

9. The method of claim 8, further comprising:

instructing the printheads to output print patches used to correlate the series of the printhead waveforms with the series of the optical density values for each of the printheads.

10. The method of claim 9, further comprising:

instructing the printheads to print the print patches as a grid of solid area tones with rows across a width of a print medium and columns along a length of the print medium, wherein each row of the print patches is printed with a constant numerical value of the parameter applied to the printheads, and a number of columns of the print patches corresponds with one printhead and the columns printed with a range of numerical values of the parameter such that the parameter applied to the printheads varies across the rows to differentiate the rows.

11. The method of claim 10, further comprising:

determining the single target optical density of each of the printheads by: determining a spectrum of values of the parameter for each of the printheads for which satellite-free patches are printed, averaging optical density measurements of satellite-free patches printed by the printheads, and averaging optical density measurements of satellite-free patches printed by the printhead.

12. The method of claim 11, further comprising:

determining, for each of the printheads, the functional relationship by fitting a monotonic regression curve to data points plotting the parameter of the printhead waveforms input to the printhead versus the optical density values output by the printhead.

13. The method of claim 12, further comprising:

determining, for each of the printheads, the target printhead waveform parameter for the printhead by:

analyzing the monotonic regression curve to determine a single value of the parameter to apply to the printhead to match the single target optical density; and determining the target printhead waveform parameter for each of the printheads with a single-pass optimization.

14. A non-transitory computer readable medium embodying programmed instructions which, when executed by a processor, are operable for performing a method comprising:

correlating, for each of a plurality of printheads, a series of printhead waveforms input to a printhead with a series of optical density values output by the printhead in response to the printhead waveforms, wherein a parameter of the printhead waveforms input to the printhead varies over a range of values for the series of the printhead waveforms;

determining a single target optical density for each of the printheads based on an average optical density of the printheads;

determining, for each of the printheads, a functional relationship between the parameter of the printhead waveforms input to the printhead and the optical density values output by the printhead;

determining, for each of the printheads, a target printhead waveform parameter for the printhead based on the single target optical density input to an inverse of the functional relationship, and updating printhead settings to include information of the target printhead waveform parameter determined for each of the printheads for applying to the printheads to output ink at consistent optical density.

15. The non-transitory computer readable medium of claim 14, the method further comprising:

instructing the printheads to output print patches used to correlate the series of the printhead waveforms with the series of the optical density values for each of the printheads.

16. The non-transitory computer readable medium of claim 15, the method further comprising:

instructing the printheads to print the print patches as a grid of solid area tones with rows across a width of a print medium and columns along a length of the print medium, wherein each row of the print patches is printed with a constant numerical value of the parameter applied to the printheads, and a number of columns of the print patches corresponds with one printhead and the columns printed with a range of numerical values of the parameter such that the parameter applied to the printheads varies across the rows to differentiate the rows.

17. The non-transitory computer readable medium of claim 16, the method further comprising:

determining the single target optical density of each of the printheads by: determining a spectrum of values of the parameter for each of the printheads for which satellite-free patches are printed, averaging optical density measurements of satellite-free patches printed by the printheads, and averaging optical density measurements of satellite-free patches printed by the printhead.

18. The non-transitory computer readable medium of claim 17, the method further comprising:

determining, for each of the printheads, the functional relationship by fitting a monotonic regression curve to data points plotting the parameter of the printhead waveforms input to the printhead versus the optical density values output by the printhead.

19. The non-transitory computer readable medium of claim 18, the method further comprising:

determining, for each of the printheads the target printhead waveform parameter for the printhead by:

analyzing the monotonic regression curve to determine a single value of the parameter to apply to the printhead to match the single target optical density; and determining the target printhead waveform parameter for each of the printheads with a single-pass optimization.

20. The non-transitory computer readable medium of claim 14, the method further comprising:

correlating the optical density values with one or more of a color, an ink type, and a printhead assembly.

* * * * *